United States Patent [19]

Hsu

[11] 4,259,763

[45] Apr. 7, 1981

[54] BILATERAL SWINGABLE SELF-CLOSING DOOR HINGE WITH COMMON BOLTING AXLE

[76] Inventor: Yun T. Hsu, No. 30-27, Chun In Rd., Chun In Village, Tong Sun Hsiang, I Lan Hsien, Taiwan

[21] Appl. No.: 31,878

[22] Filed: Apr. 18, 1979

[51] Int. Cl.[3] ..... E05F 1/06

[52] U.S. Cl. ..... 16/154

[58] Field of Search ..... 16/154, 153, 152, 68, 16/155, 168

[56] References Cited

U.S. PATENT DOCUMENTS

| | | | |
|---|---|---|---|
| 704,982 | 7/1902 | Thorp | 16/154 |
| 963,069 | 7/1910 | Roots | 16/154 |
| 1,691,759 | 11/1928 | Fischer | 16/153 |
| 2,200,418 | 5/1940 | Dudley | 16/68 |

FOREIGN PATENT DOCUMENTS

| | | | |
|---|---|---|---|
| 24418 | 12/1950 | Finland | 16/154 |

*Primary Examiner*—Andrew V. Kundrat

*Attorney, Agent, or Firm*—Cushman, Darby & Cushman

[57] ABSTRACT

A self-closing door hinge arrangement including two hinges with the structure which enables the hinges to be bolted together so as to rotate about a common axis, thereby allowing the door to swing in a balanced and smooth manner.

8 Claims, 7 Drawing Figures

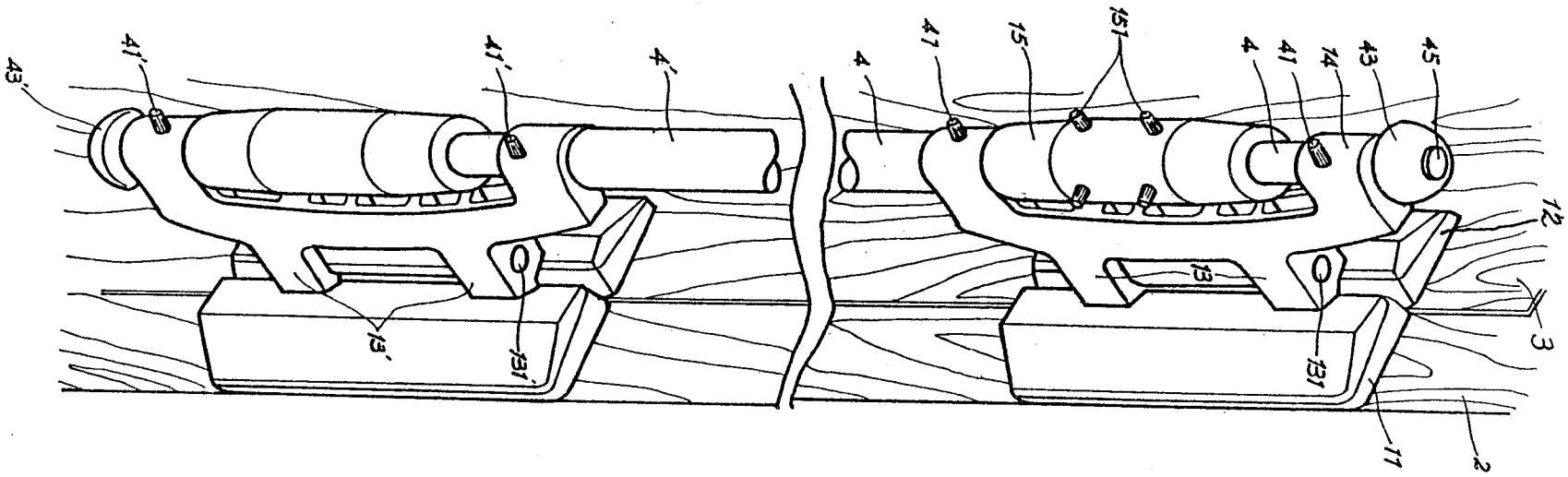
Fig. 2
Fig. 1
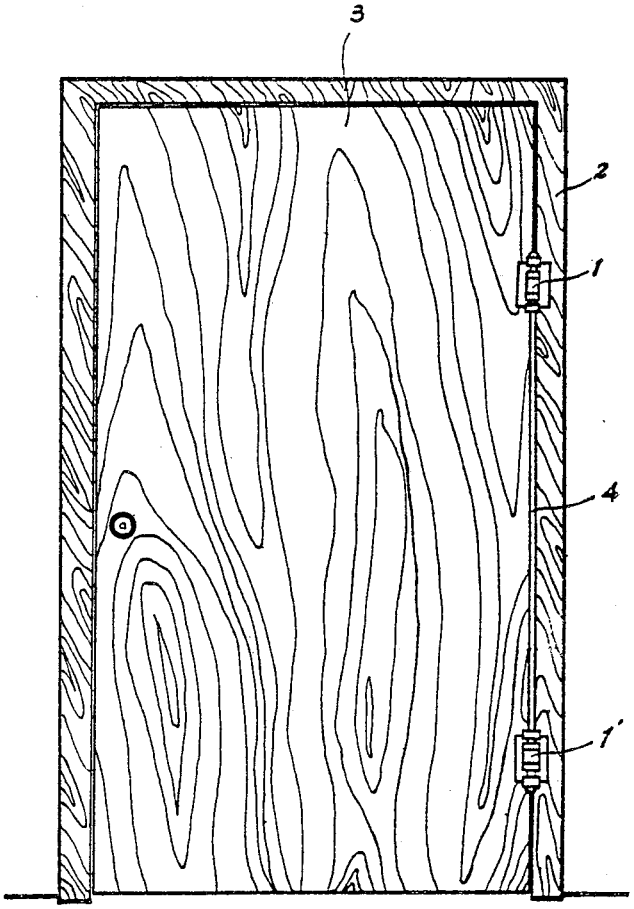
Fig. 6-A
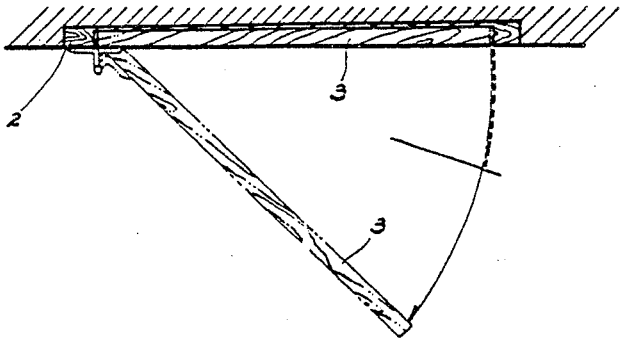

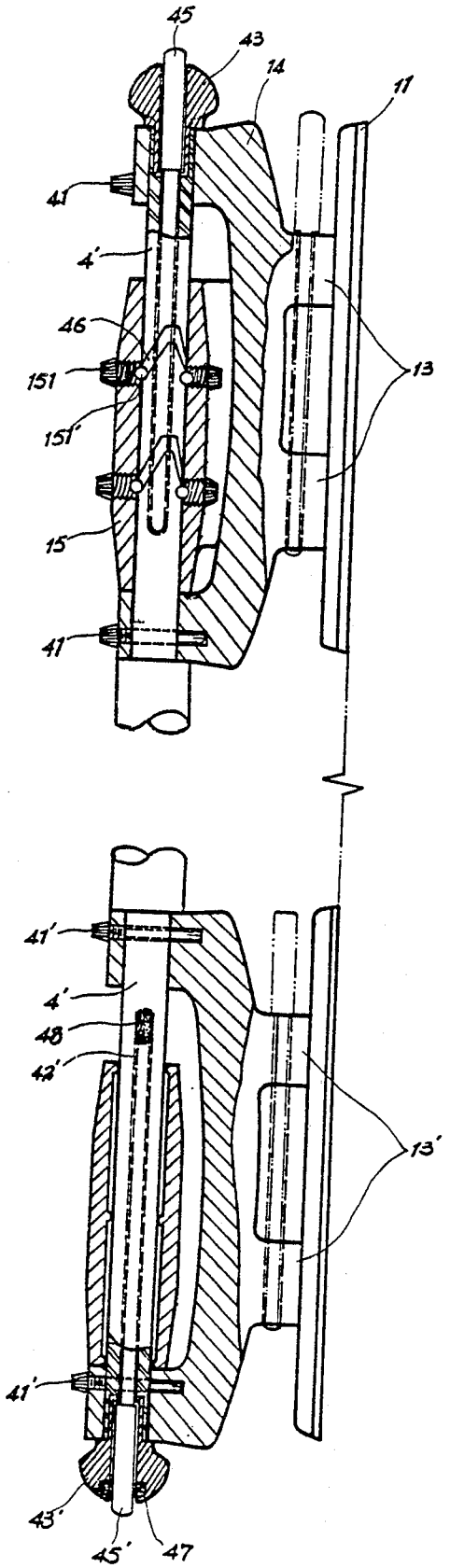
Fig. 5
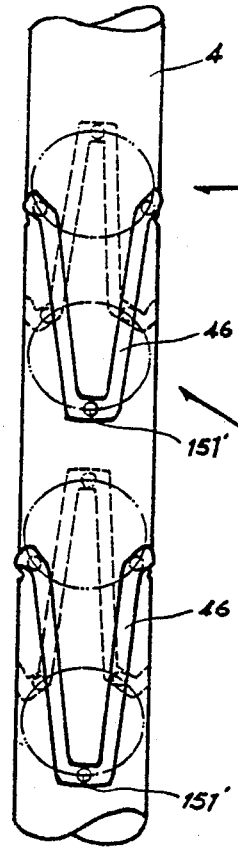
Fig 4A
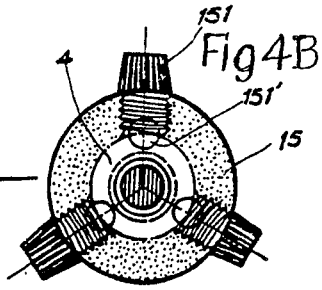
Fig 4B
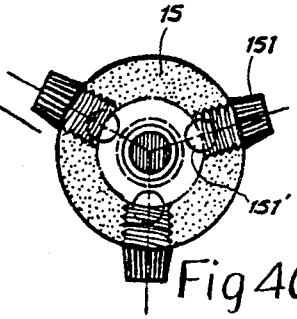
Fig 4C
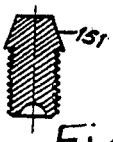
Fig. 4D
Fig. 6-B
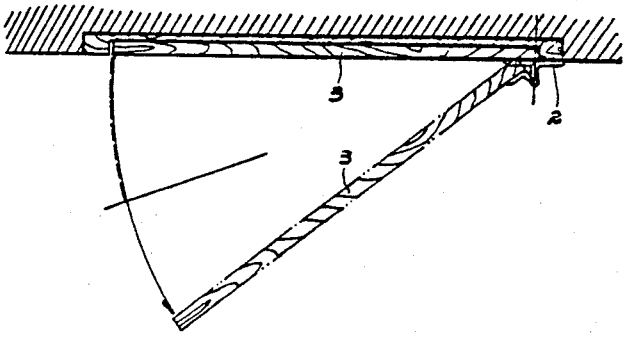

BILATERAL SWINGABLE SELF-CLOSING DOOR HINGE WITH COMMON BOLTING AXLE

BACKGROUND OF THE INVENTION

Conventional door framing requires at least two door hinges secured onto a door and a door frame. Since each of the two hinges is individually secured to the door and the frame, they therefore form separate turning axes more or less different from each other. As a result the door does not swing smoothly and exactly in a single axis.

Employing one pair of the well known type door hinges will cause difficulty in the door swinging. However, when employing the hinges disclosed in two prior applications of the same petitioner, Ser. No. 907,860 titled Self-Closing Hinge or Ser. No. 946,057 titled Bilateral Swingable Self-Closing Hinge, difficulty may exist not only in the door swinging but also in getting the door to be self-closing.

Both hinges of the two prior applications mentioned above feature at least one steel ball residing in a circular undulating groove in the joining axle part, and when the door opens the ball (or balls) rolls up on the up-going slope of the groove and soon after that the ball is (or balls) forced to roll down by the gravitation force of the door and then the door self-closes. But when one pair of hinges of the kind disclosed in the two prior applications are employed to frame a door and are not fixed in a single turning axis line will cause the two ball of the individual hinges not to roll synchroniously on the respective grooves and might cause swing of the door to be blocked.

Furthermore, the employing of one each ball in each groove of the each hinge of the prior application makes the ball (or balls) support the door in an unbalanced manner in the joining axle of the hinge and produces much friction between the ball or the ball receiver (the socket of the joining axle part) and the axle bolt (also the grooved body), and therefore might make door turning difficult.

SUMMARY OF THE INVENTION

The present invention employs axle bolts suitably connected to opposite ends of a common axle bolt with its ends also bolting hinges to a respective one of two which may be secured onto a door to enable the door to swing in a single axis line, thus ensuring smooth and unimpeded swinging and self-closing of the door. The present invention also employs at least one set of three steel balls symetrically positioned in a circle and received in the socket of the joining axle part of each hinge so as to roll on a symmetrically undulating circular groove of the axle bolt to balancingly support the weight of the door in a manner which produces little friction during turning of the door.

Other structural and functional objects will be apparent from the following description taken in connection with the accompanying drawing wherein.

BRIEF DESCRIPTION OF THE DRAWING

FIG. 1 is a front view of the present invention hinge-pair secured onto a framed door, FIG. 2 is a prospective view of the present invention hinge-pair secured onto a framed door with a portion of the common axle bolt broken a way for clarity;

FIG. 4-A, is a prospective view of the grooved bolt part of the invention; and FIGS. 4B and 4C show cross sectional views of one set of three steel balls in the high and the low of one undulating circle groove;

FIG. 4D shows a sectional view of a ball receiving element of the present invention;

FIG. 5 is a vertically cross-sectional view of the invention shown in FIG. 2;

FIG. 6A is a top view of the present invention secured onto the left side of a door with the door opening with a certain angle; and FIG. 6-B is a top view of the present invention secured onto the right side of a door.

DETAILED DESCRIPTION OF THE PREFERRED EMBODIMENT

Figure 3:
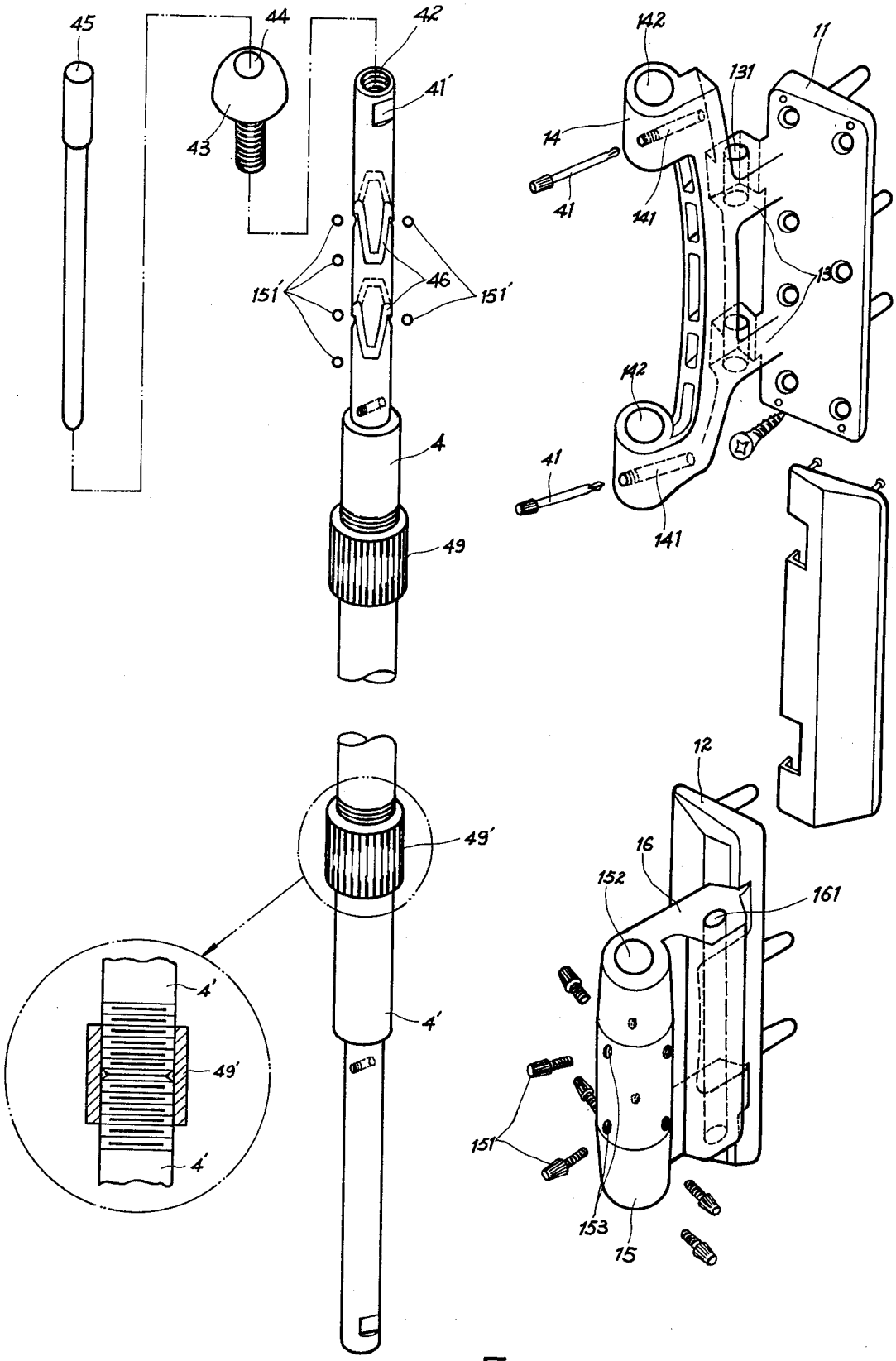
FIG. 3 is a exploded prospective view of the present invention

FIGS. 2, 3 and 5 show one hinge leaf 11 with a 90° bent out from an embracer-liked holder having two outer sockets 14 and, another hinge leaf 12 with a 90° bent out from a cylinder-like middle socket (barrel) 15. There are two axially aligned holes 142 respective hollowed through each of the outer sockets 14 and in same size with the center hole 152 of the middle socket 15 so that one axle (pintle) 4 may be bolted through these holes when the socket part 15 of the hinge leaf 12 is placed between two outer sockets 14 of the other hinge leaf 11.

Bolting axle 4 has a section inside the middle socket 15 with at least one undulating circular groove 46 (two grooves shown in FIG. 3), this groove each groove appearing as cycles of an sinusoidal wave with flattened peaks and valleys; relative to a circle about the axle as is shown on FIG. 4. The three peaks (highs) and three troughs (lows) of each groove each subtending equal 60° arcs of the circle. When axle 4 bolts together the outer sockets 14 and the socket 15 one pair of fixing pins 41 crossly screw into two horizontal cross-holes 141 in outer sockets 14 and closely secure the axle 4 respectively on two horizontal cross-grooves 41' of the axle 4. For each groove, there are three screw receiver elements 151 each of which receive at their ends half of one steel ball 151'. The three elements 151 for each groove 46 screw into three circle holes 153 of the socket 15 and press three corresponding balls the balls 151' half-residing into the middle of three troughs (valleys) of the corresponding groove 46 while the door is closed. Each groove 46 includes horizontal arc portion and climbs at each end thereof to connect to the peak. Thus balls 151' may roll inside the horizontal arc of the trough of the groove to enable the door to completely leave the door frame restriction without moving upward the balls then rolling up to the peak of the groove as shown on FIG. 6-A & 6-B. By the time a person has opened the door sufficiently to pass through, the door will certainly be lifted up, and the door will be automatically closed by the gravity of the door forcing the socket down together with the balls 151' rolling down on the same groove route back to the troughs. Three steel balls 151' equivalently positioned around the socket circle loading on each symmetrical wave groove 46 of the axle 4 thus balancingly supports the axle 4 in a balanced manner and causes little friction in turning the door.

The distances from the peaks of each groove 46 to each neighboring cross grooves 41' (also the cross-holes 141 of the outer sockets) are the same irrespective of the relative orientations of the hinge to the axle 4 and the hinge will therefore function in the same manner. When reversing each single hinge of the hinge-pair to the axle, this hinge-pair can be secured onto the other side of the door as FIG. 6-A & 6-B show. Thus the present invention will also be available for bilateral swinging purpose.

Axle 4 has one threaded end, other than that for bolting into the sockets part, joined by a jointer 49. When joining two axles by screwing their threaded ends with the jointer 49 as shown on FIG. 3, the two axles will form one common axle applied to two previously independent hinges.

The resulting structure with the common axle has a common turning axis and therefore assures a perfectly swinging door.

Bolting axle 4 has a vertical hole 42, having inner threads for receiving a screw cap 43, and a latch bolt 45 may therefore be inserted through vertical hole 44 of the cap 43 into hollow 42 of the axle 4. While latch 45 is normally placed in this way, it can if necessary be inserted through the hole 131 of the connecting part 13 of the hinge leaf 11 and the hole 161 of the connecting part 16 of another hinge leaf 12 while the door is closed to ensure that the door cannot be opened.

Inside the cap 43', there is certain magnetic material 47 sealed for keeping the latch bolt 45' from dropping down where the lower hinge of the hinge-pair provides a vertical hole 42, as FIG. 5 shows. There might also be provided a rubber ring filled inside the bottom of the axle hollow 42 for further ensuring this effect.

I claim:

1. A door hinge arrangement comprising:

a lower hinge and an upper hinge, each adapted to be mounted between a door and a door frame and including a second hinge member and a first hinge member pivotally mounted to said second hinge member;

the second hinge member of said upper hinge being pivotable about a vertical upper axis of rotation;

the second hinge member of said lower hinge being freely pivotable, independently of said second hinge member of said upper hinge, about a vertical lower axis of rotation;

means, including an elongated member fixedly connecting said first hinge member of said upper hinge to said first hinge member of said lower hinge, for aligning the first hinge members of said upper and lower hinges, respectively, so that said lower vertical axis of rotation and said upper vertical axis of rotation are aligned along a common vertical axis of rotation; and moving means, engaging the first and second hinge members of one of said upper and lower hinges, for moving the second hinge member of said one of said upper and lower hinges vertically in relation to the first hinge member of said one of said upper and lower hinges by an amount corresponding to the angular displacement about said common axis of the second hinge member of said one of said upper and lower hinges relative to the first hinge member of said one of said upper and lower hinges, the second hinge member of the other of said upper and lower hinges being vertically moveable in relation to the first hinge member of said other of said upper and lower hinges.

2. A door hinge arrangement as in claim 1 wherein said one of said upper and lower hinges comprises said upper hinge.

3. A door hinge arrangement as in claim 1 wherein the first hinge member of said upper hinge includes a first upper hinge leaf, vertically spaced apart first and second upper sockets respectively connected to said first upper hinge leaf, and an upper pintle received at top and bottom ends thereof by said first and second upper sockets;

the second hinge member of said upper hinge including a second upper hinge leaf and an upper barrel surrounding said upper pintle between said first and second upper sockets, connected to said second upper hinge leaf;

the first hinge member of said lower hinge including a first lower hinge leaf, first and second vertically spaced apart lower sockets respectively connected to said first lower hinge leaf, and a lower pintle received at top and bottom ends thereof by said first and second lower sockets;

said second hinge member of said lower hinge including a second lower hinge leaf and a lower barrel connected to said second lower hinge leaf surrounding said lower pintle between said first and second lower sockets;

said upper pintle bottom end and said lower pintle top end comprising means for releasable fixing said upper and lower pintles to opposite ends of said elongated member.

4. A door hinge arrangement as in claim 3 wherein said elongated member comprises a rod having upper and lower ends, said releaseably fixing means comprising upper and lower sleeve couplings respectively surrounding said upper pintle bottom end and said rod upper end, and said lower pintle top end and said rod lower end.

5. A door hinge arrangement as in claim 3 wherein each of said upper and lower pintles has at least one horizontal groove;

at least one of said first and second upper sockets and at least one of said first and second lower sockets each having horizontal holes therein respectively aligned with said at least one horizontal groove of said upper and lower pintles respectively to form at least two aligned horizontal holes and grooves;

said arrangement further comprising at least two pins respectively inserted through and into each of said at least two aligned horizontal holes and grooves to prevent vertical or rotational movement of said pintles in said sockets.

6. A door hinge arrangement as in claim 3 wherein said upper and lower pintles have vertical center bores adapted to slideably receive latch bolts;

said arrangement further comprising upper and lower first and second hinge arms and upper and lower connecting parts;

said upper and lower first and second sockets being respectively connected to said upper and lower first hinge leaves by said upper and lower first and second hinge arms;

said upper and lower barrels being respectively connected to said upper and lower second hinge leaves by said upper and lower connecting parts;

said upper and lower first and second hinge arms having fixedly aligned vertical bores, said upper and lower connecting parts having other vertical bores, said fixidly aligned vertical bores and said other vertical bores being alignable and adapted to receive said latch bolts to lock said upper and lower first hinge members against rotation.

7. A door hinge as in claim 3 wherein the one of said upper pintle and lower pintle included in said one of said upper and lower hinges has at least one endless, generally wave-shape groove formed therein;

said moving means comprising means, partially residing in and moveable along said at least one groove, for moving the one of said upper barrel and lower barrel included in said one of said upper and lower hinges in a path which follows said at least one groove.

8. A door hinge arrangement as in claim 7 wherein said wave of said groove has three alternately spaced and equally spaced and shaped peaks and valleys;

said moving means comprising three equally spaced balls partially residing in said at least one groove so that said arrangement may be mounted to a door and door frame so that the door will be lifted during the first 60° of turning, irrespective of which direction the door is open end and irrespective of which side of the door the hinge arrangement is mounted.

* * * * *